US006107965A

United States Patent [19]

Christ

[11] Patent Number: 6,107,965

[45] Date of Patent: Aug. 22, 2000

[54] DUAL POLARIZED ANTENNA ELEMENT WITH REDUCED CROSS-POLARIZATION

[75] Inventor: Jochen Christ, Besigheim, Germany

[73] Assignee: Robert Bosch GmbH, Stuttgart, Germany

[21] Appl. No.: 09/267,580

[22] Filed: Mar. 12, 1999

[30] Foreign Application Priority Data

Apr. 3, 1998 [DE] Germany ..... 198 15 003

[51] Int. Cl.[7] ..... H01Q 1/38

[52] U.S. Cl. ..... 343/700 MS; 343/846; 333/24 C

[58] Field of Search ..... 343/700 MS, 846, 343/848, 872, 767, 770; 333/24 C

[56] References Cited

U.S. PATENT DOCUMENTS

| | | | |
|---|---|---|---|
| 5,241,321 | 8/1993 | Tsao | 343/700 MS |
| 5,355,143 | 10/1994 | Zurcher et al. | 343/700 MS |
| 5,396,202 | 3/1995 | Scheck | 343/700 MS |
| 5,448,250 | 9/1995 | Day | 343/700 MS |
| 5,608,413 | 3/1997 | Macdonald | 343/700 MS |
| 5,668,558 | 9/1997 | Hong | 343/700 MS |
| 5,907,305 | 5/1999 | Epp et al. | 343/700 MS |

OTHER PUBLICATIONS

"Dual Slot–Coupled Microstrip Antenna For Dual Frequency Operation" by Y. Murakami et al, Electronics Letters, Oct. 28, 1993, vol. 29, No. 22, pp. 1906–1907.

"Construction Of A Slot–Coupled Planar Antenna For Dual Polarisation" by M. Yamazaki, et al, Electronics Letter, Oct. 27, 1994, vol. 30, No. 22, pp. 1814–1815.

"Printed Radiating Element With Two Highly Decoupled Input Ports" by P. Brachat et al, Electronics Letter, Feb. 16, 1995, vol. 31, No. 4, pp. 245–246.

*Primary Examiner*—Tan Ho
*Attorney, Agent, or Firm*—Michael J. Striker

[57] ABSTRACT

The dual polarized antenna element includes a planar radiating element (2) arranged in a first plane; a metallic surface (4) arranged in a second plane and provided with slots (5,6; 5,6.1,6.2) extending under the radiating element (2); a supply conductor structure (7,8) arranged in a third plane so as to be coupled with the slots (5,6; 5,6.1,6.2) in the second plane, which is located above the third plane. One slot (5) extends on a line of symmetry (11) of the radiating element (2) and the other slot (6; 6.1,6.2) runs perpendicularly to and mirror symmetric to the line of symmetry (11). In order to provide the highest possible decoupling of both polarizations, the other slots (6; 6.1,6.2) running perpendicular to the line of symmetry (11) is coupled with a supply conductor (8) of the supply conductor structure (7,8) at two points (12,14;13,15) located at respective mirror symmetric positions relative to the line of symmetry and is mirror symmetric to the line of symmetry (11) thus acting as a branching conductor.

3 Claims, 1 Drawing Sheet

DUAL POLARIZED ANTENNA ELEMENT WITH REDUCED CROSS-POLARIZATION

BACKGROUND OF THE INVENTION

The present invention relates to a dual polarized antenna element and, more particularly to a dual polarized antenna element comprising a planar radiating element arranged in a first plane, a metallic surface arranged in a second plane, which has at least two slots extending under the radiating element, and a supply conductor structure arranged in a third plane and coupled with the slots in the second plane which is above the third plane, in which one of the slots extends on a line of symmetry of the radiating element and at least one of the other slots runs perpendicularly to and mirror symmetric to the line of symmetry, whereby the slots are coupled with separate supply conductors.

Planar antennas, comprising a plurality of such dual polarized antenna elements, for example can be used in a base station and a subscriber's station of a point-to-multipoint radio communication system. This sort of planar antenna element has the advantage of a great flexibility in antenna characteristics during broadcasting, and may be manufactured economically in large numbers. In the point-to-multipoint radio communication system the radio link area about the base station is divided into several sectors, in which an individual planar antenna is present for each radio link sector. In order to obtain the greatest possible transmission capacity, the transmission channels in neighboring sections or also the transmission and reception channels within a sector carry different polarizations. When the use of separate transmission and reception antennas is avoided to save space, an antenna with dual polarized antenna elements can be used for both transmission and reception.

A dual polarized antenna element of the triggered type is described in Electronics Letters 31, No. 4, pp.245–246(Feb. 16, 1995). Besides a slot extending on a line of symmetry of the radiating element this antenna element has two other slots extending perpendicular to the opposing edges of the radiating element. The slot extending on the line of symmetry is coupled with a planar supply conductor for waves of a first polarization and a second supply conductor for waves of a second polarization is coupled with the other slots by means of a branching conductor. The dual polarized antenna element thus conceived has however a relatively high cross-polarization of between 32 and 35 dB.

SUMMARY OF THE INVENTION

It is an object of the present invention to provide a dual polarized antenna element of the above-described type whose cross-polarization is minimized, i.e. so that it is as small as possible.

These objects, and others which will be made more apparent hereinafter, are attained in a dual polarized antenna element comprising a planar radiating element arranged in a first plane, a metallic surface arranged in a second plane, which has at least two slots extending under the radiating element, and a supply conductor structure arranged in a third plane and coupled with the slots in the second plane which is above the third plane, in which one of the slots extends on a line of symmetry of the radiating element and at least one of the other slots extends perpendicularly to and mirror symmetric to the line of symmetry, whereby the slots are coupled with separate supply conductors.

According to the invention one of the slots extending perpendicular to the line of symmetry of the radiating element is coupled with a supply conductor at two points located at respective mirror symmetric positions relative to the line of symmetry. Also the supply conductor extending mirror symmetrically to the line of symmetry (11) forms a branching conductor.

This strictly symmetric arrangement of the slots and the supply conductors coupled to them produces a high decoupling of the perpendicularly polarized wave modes. This arrangement provides a polarization decoupling of about 38 dB with a relative bandwidth of about 5.7%.

Various preferred embodiment with advantageous additional features are described hereinbelow.

Accordingly the slot extending perpendicular to the line of symmetry can be divided into two slot sections or extend to the edge region of the radiating element. The two slot sections may extend on both sides of the slot extending along the symmetry line and each slot section may be coupled with one arm of the mirror-symmetric branching conductor. Because of the division of the one slot into two slot sections it is possible to arrange the slots extending orthogonal or perpendicular to each other close to each other so that the size of the antenna element can be reduced in this advantageous manner.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
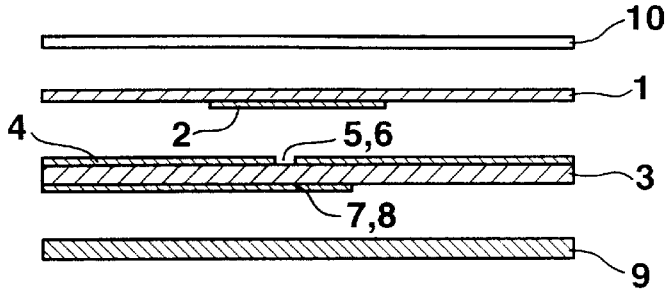
FIG. 1 is a transverse cross-sectional view through one embodiment of an antenna element according to the invention.

In FIG. 1 a planar dual polarized antenna element is shown in a cross-sectional view. This antenna element has a radiating element (patch) 2 arranged in a first plane on a substrate 1. A metallic surface 4 is provided on the surface of a second substrate 3 in a plane arranged under the first plane. A plurality of coupling slots 5,6 are provided in the metallic surface 4 as is seen in more detail in FIGS. 2 and 3. In a third plane, in fact on the underside of the second substrate 3, a supply conductor structure 7,8 is arranged as shown in detail in FIGS. 2 and 3. A ground surface 9 is arranged in the lowest plane. A plastic cover (Radom) 10 can be provided for protection of the antenna element. The intervening spaces 10, 1, 3 and 9 between the planes are filled with a dielectric material, which has a lower dielectric constant than the substrates 1 and 3, e.g. for example the dielectric material may be air.

A planar group antenna is built from a plurality of these individual antenna elements.

Figure 2:
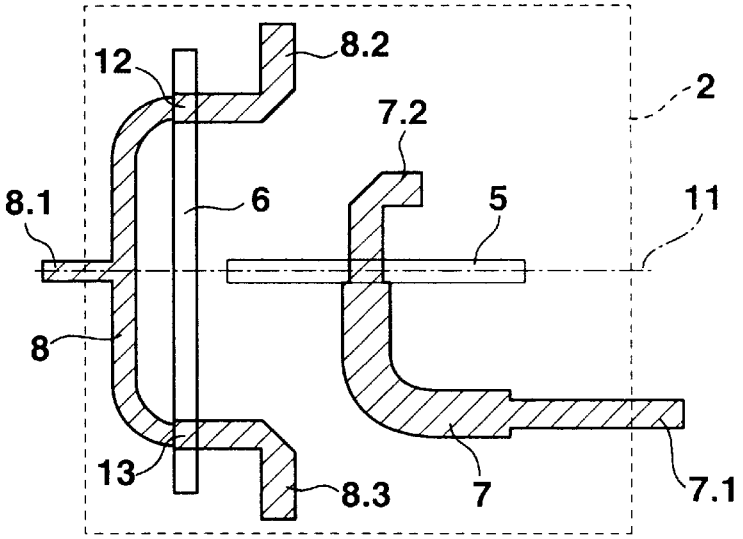
FIG. 2 is a plan view of an antenna element with coupling slot in the edge region.

A plan view of one embodiment of an individual polarized antenna element is shown in FIG. 2, in which the edges of the radiating element surface are shown with dashed lines and the coupling slots 5 and 6 and the supply conductors 7 and 8 extend under it. As has been stated already, the antenna element should be dual polarizable. Thus both coupling slots 5 and 6 are arranged perpendicular to each other so that two perpenduclar wave modes can be coupled to the radiating element 2. The first coupling slot 5 extends on a line of symmetry 11 of the radiating element 2. The line of symmetry 11 divides the, e.g. here formed square, radiating element 2 in two equal sized surface sections.

One supply conductor 7 crosses over the center of the coupling slot 5. Thus a wave of a first polarization supplied at input 7.1 of the supply conductor 7 is coupled to the slot 5. A piece 7.2 of this conductor extending over the slot 5 operates to tune the conductor 7 to the slot 5.

The coupling slot 6 for the second polarization extends perpendicular to coupling slot 5. The coupling slot 6 extends from the center of the radiating element 2 to its edge region. The coupling slot 6 extends mirror symmetric to the line of symmetry 11. The coupling of the wave modes with a second polarization to the coupling slot 6 occurs by means of a supply conductor formed as a branching conductor 8. The input 8.1 of the supply conductor, to which the wave of the second polarization is supplied, branches into two mirror conductor arms arranged mirror symmetrically to the line of symmetry 11, of which each crosses over the coupling slot 6 at the respective points 12, 13 and is terminated by respective conductor pieces 8.2 and 8.3 which operate to tune the coupling. The entire supply conductor extending mirror symmetrically to the line of symmetry 11 is coupled with the coupling slot 6 at the two points 12 and 13 located at positions that are also mirror symmetric with respect to the line of symmetry 11. Because of the highly symmetric slot and conductor configuration of the dual polarized antenna element of the invention, a very high degree of decoupling between the perpendicularly polarized wave modes is attained. The decoupling is assisted because the lead sections 7.1 and 8.1 of both supply conductors 7 and 8 extend from opposite sides of the radiating element 2.

Figure 3:
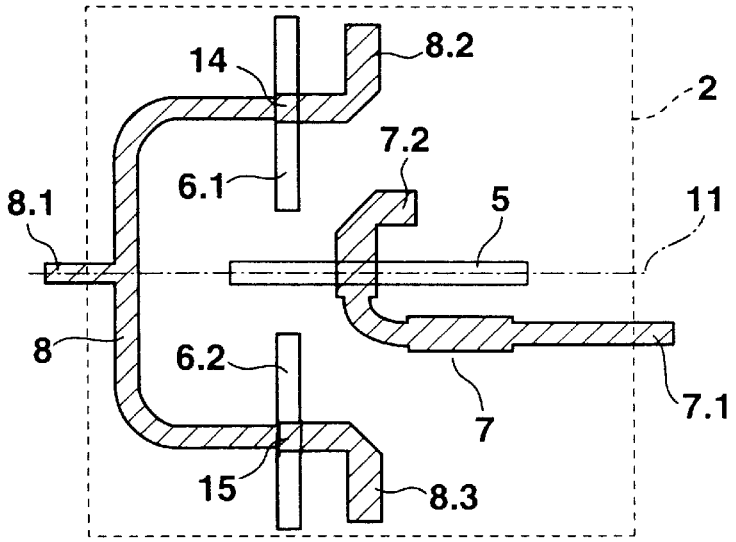
FIG. 3 is a plan view of another embodiment of an antenna with a two-section coupling slot.

Another embodiment of the antenna element of the invention is shown in FIG. 3. In this latter embodiment the slot 6 is divided into two slot sections 6.1 and 6.2, which extend perpendicular and mirror symmetrically to the axis of symmetry 11 on both sides of the coupling slot 5. Because of the division of the slot 6 into the two slot sections 6.1 and 6.2 now both slot sections can be moved away more from the edge of the radiating element 2 toward the center. This arrangement of the coupling slots 5 and slot sections 6.1 and 6.2 permits a reduction of the area of the antenna element. Both arms of the branching conductor 8 are coupled with the respective slot sections 6.1 and 6.2 at a points 14 or 15. Also here both coupling points 14 and 15 are located at positions which are mirror symmetric to the line of symmetry 11.

The disclosure in German Patent Application 198 15 003.2 of Apr. 3, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in an improved dual polarized antenna element, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

I claim:

1. A dual polarized antenna element comprising a planar radiating element (2) arranged in a first plane and having a line of symmetry (11);

a metallic surface (4) arranged in a second plane and provided with a plurality of slots (5,6; 5,6.1,6.2) extending under the radiating element (2);

a supply conductor structure arranged in a third plane so as to be coupled with the slots (5,6; 5,6.1,6.2) in the second plane, said second plane being located above said third plane and said supply conductor structure comprising separate supply conductors (7,8), each of said separate supply conductors being arranged in said third plane;

wherein one (5) of the slots extends on the line of symmetry (11) of the radiating element (2) and at least one other (6; 6.1,6.2) of the slots extends perpendicularly to the line of symmetry and mirror symmetric to the line of symmetry, whereby the said one (5) and said at least one other (6; 6.1,6.2) of the slots are coupled with respective ones of said separate supply conductors (7,8); and wherein said at least one other (6; 6.1,6.2) of the slots running perpendicular to the line of symmetry (11) of the radiating element (2) is coupled with one (8) of said supply conductors at two points (12,14;13,15) located at respective mirror symmetric positions relative to the line of symmetry and said one (8) of said supply conductors extends mirror symmetrically to said line of symmetry (11) so as to form a branching conductor.

2. The dual polarized antenna element as defined in claim 1, wherein said at least one other (6; 6.1,6.2) of the slots running perpendicularly to the line of symmetry (11) extends into edge regions of the radiating element (2).

3. A dual polarized antenna element comprising a planar radiating element (2) arranged in a first plane and having a line of symmetry (11);

a metallic surface (4) arranged in a second plane and provided with a plurality of slots (5,6; 5,6.1,6.2) extending under the radiating element (2);

a supply conductor structure arranged in a third plane so as to be coupled with the slots (5,6; 5,6.1,6.2) in the second plane, said second plane being located above said third plane and said supply conductor structure comprising separate supply conductors (7,8);

wherein one (5) of the slots extends on the line of symmetry (11) of the radiating element (2) and at least one other (6; 6.1,6.2) of the slots extends perpendicularly to the line of symmetry and mirror symmetric to the line of symmetry, whereby the said one (5) and said at least one other (6; 6.1,6.2) of the slots are coupled with respective ones of said separate supply conductors (7,8); and wherein said at least one other (6; 6.1,6.2) of the slots running perpendicular to the line of symmetry (11) of the radiating element (2) is coupled with one (8) of said supply conductors at two points (12,14;13,15) located at respective mirror symmetric positions relative to the line of symmetry and said one (8) of said supply conductors extends mirror symmetrically to said line of symmetry (11) so as to form a branching conductor;

wherein said at least one other (6; 6.1,6.2) of the slots running perpendicularly to the line of symmetry (11) is divided into two slot sections (6.1,6.2), said two slot sections are arranged on respective opposite sides of said line of symmetry (11), said branching conductor is divided into arms extending on opposite sides of the line of symmetry and each of said two slot sections is coupled with a respective arm of said branching conductor.

* * * * *